United States Patent [19]

Priest et al.

[11] 4,033,132

[45] July 5, 1977

[54] POSITION-TRANSMITTING EQUIPMENT

[75] Inventors: Anthony Victor Norton Priest, Harpenden; Murray Arnold Schorr, Bletchley, both of England

[73] Assignee: Alfred Walter Barker, Guernsey, Channel Islands

[22] Filed: Aug. 4, 1975

[21] Appl. No.: 601,407

[52] U.S. Cl. ..... 60/572; 60/584; 60/587; 60/594

[51] Int. Cl.[2] ..... F15B 7/10; F15B 7/08

[58] Field of Search ..... 60/584, 594, 572, 585, 60/587, 586

[56] References Cited

UNITED STATES PATENTS

| | | | |
|---|---|---|---|
| 577,342 | 2/1897 | Bain | 60/572 |
| 2,669,096 | 2/1954 | MacDuff | 60/584 |
| 2,882,686 | 4/1959 | Griffith | 60/572 |
| 2,997,849 | 8/1961 | Shimonckas | 60/584 |
| 3,209,541 | 10/1965 | Dunphy | 60/594 |
| 3,299,637 | 1/1967 | Ballard | 60/572 |

*Primary Examiner*—Paul E. Maslousky

[57] ABSTRACT

A position-transmitting equipment especially suitable for transmitting steering commands in a small watercraft comprises a transmitter unit in which a cylinder is reciprocable endwise in a housing in accordance with position information to be transmitted. The cylinder is divided internally into two working chambers by a transverse partition. A gland at each end of the cylinder seals about a tubular plunger fixed to the housing so that reciprocation of the cylinder differentially adjusts the working chamber volumes, without risk of jamming and the need for close tolerances. The housing, cylinder and plungers can all be made of plastics material. The plungers provide communication via conduits to a double-acting actuator constituting a receiver unit. The equipment optionally includes a recuperator unit to maintain a selected working fluid pressure in the system.

11 Claims, 5 Drawing Figures

POSITION-TRANSMITTING EQUIPMENT

FIELD OF THE INVENTION

The invention concerns hydraulic position-transmitting equipment that is especially adapted to the transmission of the position of a control element within its working range to an indicator and/or actuating device at a remote location for the purpose of indicating and/or directly or indirectly influencing the setting of a mechanism in response to the transmitted position of the control member. A particular application of the equipment of the invention is the transmission of steering commands from a wheel or tiller to the rudder or other steering mechanism of a watercraft, a specific object of the invention being the provision of simple, low cost and reliable remote steering gear for small watercraft such as motor cruisers, speedboats, hydrofoils, inflatables and other like craft that require steering gear which can be connected and disconnected in simple fashion and with minimum use of tools by users having no particular mechanical skill, e.g. during launching and landing of such water craft.

THE INVENTION

Position-transmitting equipment embodying the invention comprises a transmitter unit including a housing, a cylinder and means for moving the cylinder axially within the housing in accordance with position information to be transmitted, a transverse partition dividing the said cylinder into two working chambers. Each end of the housing has, fixed thereto, an individual tubular plunger that has sealing telescopic relationship to the cylinder so that axial movement of the cylinder with respect to the housing causes relative displacement of said plungers and the cylinder to effect differential adjustment of the volumes of said working chambers. The equipment further comprises a receiver unit including a double-acting hydraulic actuator having working chambers adapted for connection via said plungers to the working chambers of the cylinder of said transmitter unit, thereby to respond to adjustment of said cylinder within said housing.

Conveniently said housing is tubular and substantially coaxially disposed with respect to the cylinder and plungers, the means for moving the cylinder within the said housing comprising a pinion on a shaft carried by said housing and meshing with rack teeth formed on the exterior of said cylinder.

The form of the transmitter unit lends itself to the construction of at least its major components in plastics material by moulding and like techniques. Moreover because the volumes of the working chambers of the cylinder are differentially adjusted by movement of the cylinder relatively to the said plungers, which enter the respective working chambers to a variable extent, the tolerances and finishes achievable by recognised moulding techniques are acceptable for the cooperating parts of the plungers and cylinder.

In preferred embodiments of the invention, the cylinder of the transmitter unit is divided into working chambers by a single partition extending across its bore midway between its ends, a valve assembly in the region of the partition controlling passages by means of which the working chambers may be put into communication with one another when desired for the purpose of synchronising the positions of the transmitter unit and the receiver unit. The valve assembly may also provide for connection of the working chambers with an external fluid connection, e.g. for introducing working fluid into, or bleeding working fluid from, said chambers as and when required.

Conveniently the valve assembly comprises a tubular boss extending radially outwardly from the wall of the cylinder and running in a slot or equivalent guide in the housing so as to define the permitted motion of the cylinder within the housing. If, as is preferred, the valve assembly extends to the exterior of the housing in a suitable location, its position within the length of the slot or guide in the housing, or with respect to a suitable scale carried by the housing, may serve for indication of the position of the cylinder within the housing and thus of position information being transmitted to the receiver unit.

In preferred embodiments of the invention the valve assembly comprises an internally screwthreaded sleeve extending from a tubular boss on the external wall of the cylinder in the region of the internal partition therein, an aperture on the axis of the boss communicating with a passage leading to the working chamber on one side of the partition, while an offset aperture within the boss communicates with a passage extending to the other working chamber. The bore of the boss is finished to mate with a peripheral seal on a valve head having a central protuberance for closing said axial aperture, the valve head being carried by a stem having an external screwthread co-operating with the screwthread in the sleeve so that rotation of the stem by, for instance, rotating an external knob on the end of the stem, serves to move the valve head towards and away from the said apertures. The said sleeve is of larger bore than the boss and joins the latter in a tapering bore section, the arrangement being such that the valve head may be partly withdrawn to provide simple communication between the two working chambers via the bore of the boss, or the valve head may be fully withdrawn into the sleeve to provide access between the bore of the boss and the bore of the sleeve behind the seal on the valve head, thereby to provide communication between the working chambers and a bleed passage in the valve head behind its seal, the bleed passage extending to the external end of the valve stem.

The said reciever unit may comprise any suitable double-acting hydraulic actuator with working chambers appropriately matched to the working chambers of the cylinder of the transmitter unit. However, the receiver unit conveniently comprises a cylinder having a piston reciprocable therein and carried by a piston rod extending through a suitable gland at one end of the cylinder, each end of the cylinder being provided with a connection for a conduit leading to the associated working chamber of the transmitter unit and preferably also having a screw-down bleed valve.

With a receiver unit of this form, in which the working chambers differ in cross sectional area by reason of the inclusion of the piston rod in one chamber, the cross sectional areas of the working chambers of the transmitter unit are made suitably different so as to achieve substantial constancy of connected working chamber volumes for all corresponding positions of the two units.

The corresponding working chambers of transmitter unit and receiver unit may be adapted for connection by any suitable conduit means which may be rigid or flexible as desired and to suit the intended installation. Usually, however, the conduits will be of flexible plastics or like hose provided with suitable break-joints where required.

The equipment may use any suitable working fluid, suitability being determined, inter alia, by the requirements of the installation for which the equipment is intended and by the materials of construction of the equipment components which will come into contact with that fluid. In some installations an oil-based fluid will be desirable but in many instances water, perhaps including a dissolved lubricant and/or being admixed with an anti-freeze liquid, will be a suitable working fluid.

Preferably the equipment will include a recuperator unit in circuit with the working chambers of the transmitting unit and of the receiver unit so as to maintain the working fluid in these chambers under a suitable pressure and to accommodate variations in fluid circuit volume due, for instance, to differential thermal expansion effects and to asymmetry.

Thus in preferred embodiments of the invention, each working chamber of the transmitter unit is connected to the corresponding working chamber of the receiver unit via an individual passage in a recuperator unit, the respective passages in the latter being connected via individual pressure relief valves to a reservoir of pressurised working fluid so that excess pressure in either passage will be relieved by flow of fluid into the reservoir thereby to protect the receiver and transmitter units and the conduits and so on against pressure overloads.

The recuperator unit preferably comprises a reservoir vessel adapted to be pneumatically pressurised to maintain working fluid therein under a required pressure. There may be a piston or diaphragm separating the pressurising air from the working fluid in the reservoir and in such cases the pneumatic pressurising may be supplemented by spring loading or the like on the piston or diaphragm. However, in preferred embodiments the working fluid in the reservoir is directly exposed to the pressurising air.

The recuperator unit preferably also provides for simple and rapid charging of the working chambers and their connecting conduits with working fluid when the fluid circuits are established. To this end, the reservoir has a fluid feed via a make-up valve to said passages so that upon opening of the make-up valve working fluid may flow from the reservoir to said passages under the force of the pressurising air.

To facilitate charging of the reservoir with working fluid, the reservoir may be detachable from the remainder of the recuperator unit and is preferably transparent or translucent so that the working fluid level therein is visible.

THE DRAWINGS AND DESCRIPTION OF PREFERRED EMBODIMENT

A preferred embodiment of the invention is illustrated in the accompanying drawings which show transmitter, receiver and recuperator units suitable to be constructed mainly of plastics materials (for instance acetal copolymer) and to utilise as working fluid water containing a glycol-type antifreeze. In these drawings.

Figure 1:
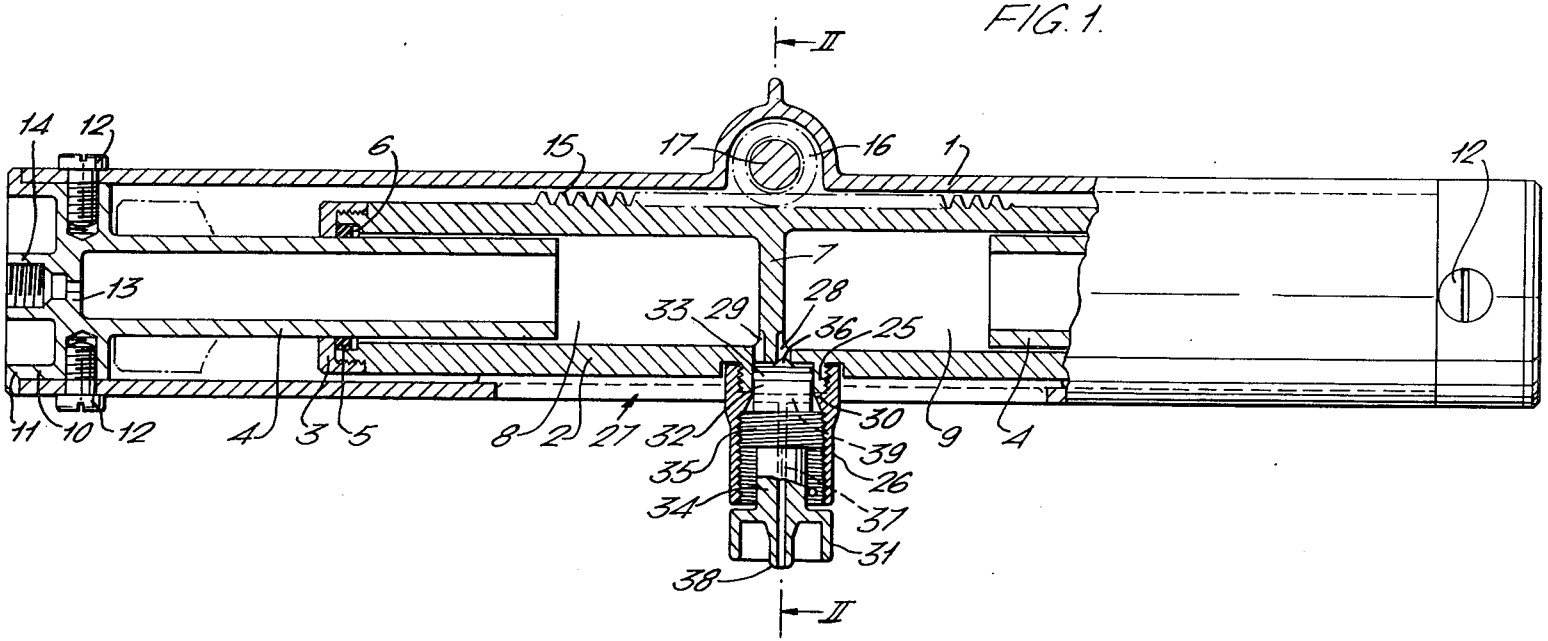
FIG. 1 is a part-sectional elevation of the transmitter unit, showing the bypass and bleed valve thereof in a fully closed position.
Figure 2:
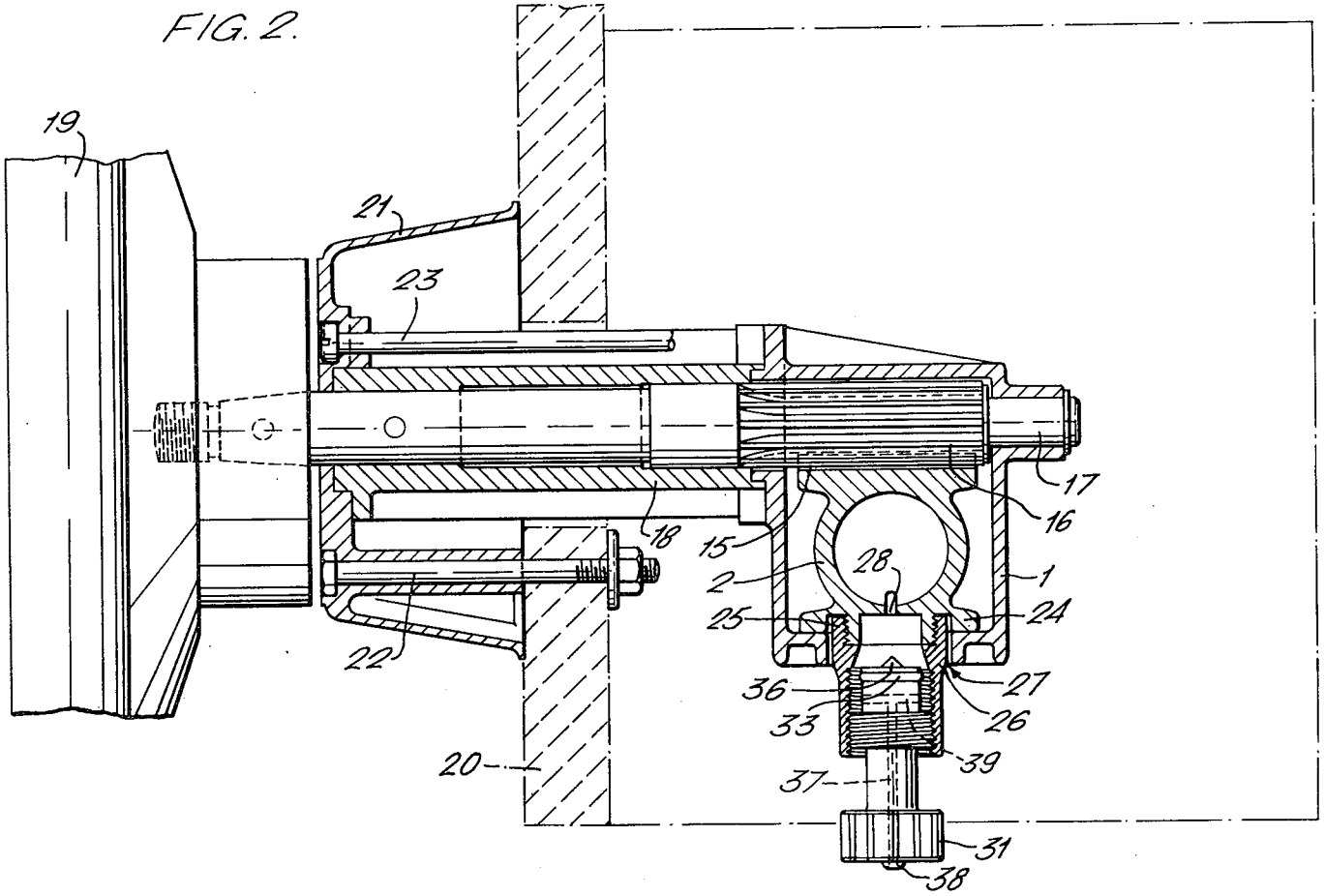
FIG. 2 is a section on line II—II, FIG. 1, showing also the fixing of the transmitter unit to a fascia board and illustrating the bypass and bleed valve in its fully-open condition.

The transmitter unit shown in FIG. 1 and 2 comprises a tubular housing 1 within which a cylinder 2 is coaxially arranged and slidable longitudinally therein. Each end of the cylinder 2 is fitted with a gland nut 3 through which a tubular plunger 4 extends, the gland nut 3 trapping a flexible seal 5 between itself and a backing ring 6 in a counterbore in the end of the cylinder 2, the seal 5 running on the external surface of the plunger 4.

As shown in FIG. 1, each plunger 4 has substantial radial clearance in the bore of the cylinder 2. The cylinder 2 is internally divided by a transverse position 7 into two working chambers 8, 9 and as will be apparent from FIG. 1 the chamber 8 has a smaller diameter than the chamber 9 so that the volumes of the chambers 8 and 9 change by different amounts when the position of the cylinder 2 within the housing 1 is adjusted, as hereinafter explained.

Each of the plungers 4 has an enlargement 10 at its outboard end that fits within the end of the housing 1 and has a flange 11 that abuts against the end of the housing so as to locate its associated plunger 4 in fixed position within the housing and with its axis aligned with the housing axis. The plungers are secured in their respective positions at the housing ends by fixing screws 12 extending through the housing wall and into the enlargements 10.

The bore of each plunger 4 is closed by a ported end wall 13 formed with a central boss 14 that is internally screw-threaded to receive a conduit union (not shown) by means of which a connecting conduit may be placed in communication with the bore of the plunger and thus with the associated working chamber 8 or 9 of the cylinder 2.

The cylinder 2 is formed externally with rack teeth 15 that mesh with a pinion 16 on a driving shaft 17 that extends transversely of the housing and through a bearing sleeve 18 to receive a tiller or steering wheel 19 as shown in FIG. 2. In this embodiment the transmitter unit is adapted to be supported by the bearing sleeve 18 and for this purpose the latter is provided with fixings by which it may be attached to, for instance, a fascia board such as indicated at 20. The fixings in this case comprise a cup-like bezel 21 adapted to be through-bolted as by bolts 22 to the fascia board 20 and to be secured to the bearing sleeve 18 by means of bolts 23 that extend to the housing 1 and hold the bearing sleeve 18 trapped between the bezel 21 and the housing.

FIG. 2 shows only one each of the bolts 22 and 23: there are in fact four bolts 22 and four bolts 23 arranged alternately in equi-spaced array in a common pitch circle about the bezel 21 and bearing sleeve 18.

As best seen in FIG. 2, the housing 1 is of rectangular cross section presenting a flat lower wall to the lower side of the cylinder 2 that is formed with a flat flange 24 to run on the lower wall of the housing. The rack teeth 15 are formed on a flat flange on the upper side of the cylinder 2 and by virtue of their substantial width meshing with the pinion 16 serve to hold the cylinder 2 with its flange 24 in engagement with the lower wall of the housing.

In the vicinity of the partition 7, the underside of the cylinder 2 is formed with a tubular boss 25 that is externally screwthreaded to receive the body 26 of a bypass and bleed valve assembly that projects through a slot 27 in the underside of the housing 1.

The bore of the boss 25 communicates via a central port 28 with the working chamber 9 of the cylinder 2 and, via an offset port 29, with the working chamber 8 of the cylinder. As shown in FIG. 1 the ports 28, 29 are partly formed by grooves in the opposite faces of the partition 7.

The body 26 of the bypass bleed valve assembly is formed at its upper end with an internal flange 30 that abuts against the end of the boss 25 and has a tapering bore extending into a bore portion that is of larger diameter than the bore of the boss 25 and is internally screwthreaded.

The valve assembly further comprises a valve member 31 having a valve head 32 carrying an O-ring seal 33 capable of sealing engagement with the bore of the boss 25. The valve member 31 carries the valve head 32 on a stem 35 having a collar 35 that is externally screwthreaded and engages with the internal screwthreads in the larger bore portion of the housing 26.

The end face of the valve head 32 is formed with a central protuberance 36 that is positioned and sized to enter and close the port 28 when the valve member 31 is screwed fully into the sleeve-like body 26 of the valve assembly, thereby to prevent communication between the working chambers 8 and 9 of the cylinder 2 via the ports 28, 29 and the bore of the boss 25.

The valve member 31 has a central passage 37 extending from a nipple 38 at the outer end of the member to a transverse passage 39 in the valve head 32 behind the seal 33 on the latter. this passage 39 thus communicates with the larger bore portion of the body 26.

FIG. 1 shows the valve member 31 screwed fully home into the valve body 26 so that the protuberance 36 closes the port 28 in the manner above described. If the valve member 31 is rotated so as to withdraw its head 32 a short distance from this fully-closed position, the protuberance 36 is moved clear of the port 28 so that this is placed in communication with the bore of the boss 25 and thus with the port 29, so establishing communication between the working chambers 8 and 9, for a purpose hereinafter to be described. However, in this partly-open position, the seal 33, by engaging the bore of the boss 25, prevents communication between the bore of the boss and the larger bore portion of the valve body 26 behind the flange 30.

If, however, the valve member is rotated to withdraw the valve head 32 further to fully-open position shown in FIG. 2, in which the seal 33 is clear of the bore of the boss 25 and is positioned in the larger bore portion of the valve body 26, communication is established between the ports 28, 29 and the passage 39 and thence with the passage 37 to the nipple 38.

Figure 3:
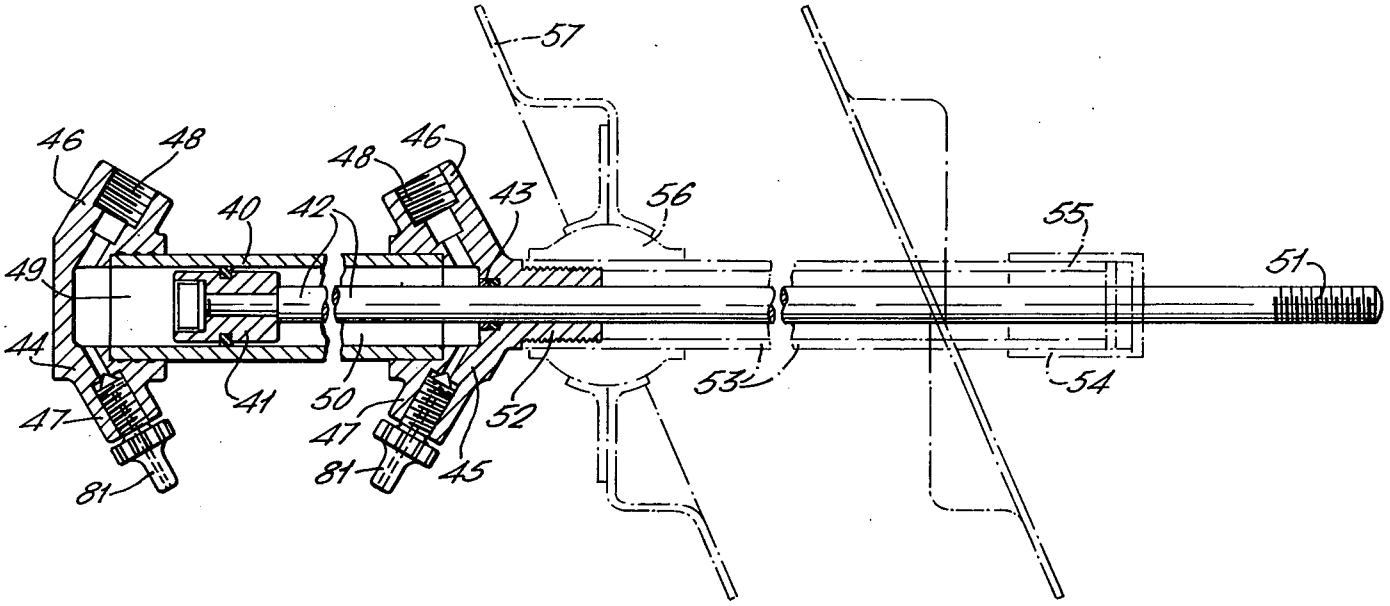
FIG. 3 is a sectional elevation of the receiver unit.

The receiver unit that is used with the transmitter unit of FIGS. 1 and 2 is shown in FIG. 3 and comprises a double-acting hydraulic actuator constituted by a cylinder 40 and a piston 41 that is reciprocable within the cylinder 40 and is carried at the end of the piston rod 42 that extends through a gland seal 43 at one end of the cylinder 40. The ends of the cylinder 40 are closed by ends caps 44, 45 each of which has a pair of bosses 46, 47 that respectively have bores communicating with the associated end of the cylinder 40 and thus with the working chamber of the actuator defined between that end of the cylinder and the piston 41. The bosses 46 are formed with screwthreaded bores 48 to receive unions at the ends of the conduits by which the working chambers of the actuator are connected to the working chambers 8, 9 of the transmitter unit via the recuperator unit to be described.

As noted the piston 41 divides the cylinder 40 of the actuator into two working chambers: a chamber 49 at the left hand end of the actuator as seen in FIG. 3 has a cross-sectional area equal to that of the cylinder 40 while a chamber 50 on the righthand side of the piston has a smaller effective cross-sectional area by reason of the presence of the piston rod 42 in that chamber. It is for this reason that the working chambers 8, 9 of the transmitter unit have different cross-sectional areas so that the connected working chambers of the transmitter unit and receiver unit actuator may be displacement-matched. Thus, the larger area working chamber 49 of the receiver unit actuator is connected to the larger area working chamber 9 of the transmitter unit while the smaller area working chamber 50 of the actuator is connected to the smaller area working chamber 8 of the transmitter unit. The relationship between the effective cross-sectional areas of the working chambers of the two units is such that any displacement of the transmitter unit cylinder 2 within its housing 1, giving a change in the volumes of the respective chambers 8, 9, may be matched by a proportional displacement of the piston 41 in the cylinder 40 of the receiver unit actuator giving a corresponding change in the volumes of the working chambers 49, 50.

Thus a displacement of the cylinder 2 in the housing 1 of the transmitter unit may be matched by a proportionate displacement of the piston 41 in the cylinder 40 of the receiver unit without net change in the volumes of the connected working chambers of the respective units: that is to say, the sum of the volumes of the working chambers 9 and 49 remains constant for proportionate displacements of the cylinder 2 and the piston 41, as does also the sum of the volumes of the connected working chambers 8 and 50.

The receiver unit is adapted to be mounted on, e.g., the transome of a small watercraft and to have the free end 51 of the piston rod 42 connected to the rudder, outboard motor or other steering mechanism of the watercraft in such manner that movement of the piston 41 within the cylinder 40 effects steering movements of the steering mechanism. In the embodiment illustrated in FIG. 3, provision is made for fixing the receiver unit to the watercraft structure with allowance for adjustment of its axial position and axial orientation relative to the fixing point to suit a particular installation.

Thus the end cap 45 of the actuator is formed with a screwthreaded spigot 52 on which is screwed an extension tube 53 having an end cap 54 through which the free end of the piston rod 42 extends. The extension tube 53 is fitted with a bearing sleeve 55 that supports the piston rod 42 to maintain alignment of the piston rod with the common axes of the extension tube 53 and the cylinder 40.

A ball mount 56 is fitted slidably on the extension tube 53 and is adapted to be secured at an adjusted position therealong by clamps (not shown). The ball mount 56 supports a mounting flange 57 that is rockable on the ball mount through an angle of say 20°, in any plane, about the centre of the ball mount, from the mean position shown in FIG. 3 and the mounting flange 57 is itself angularly offset at about 20° so that by appropriately rotating the flange and ball mount 56 above the extension tube 53 and rocking the flange on the ball mount the axis of the actuator may be set in a desired orientation with respect to the plane of the transome or other part of a watercraft to which the mounting flange 57 is to be attached. Likewise by adjusting the ball mount 56 along the extension tube 53 the "reach" of the piston rod end 51 from the fixing point for the flange 57 may be adjusted.

Figure 4:
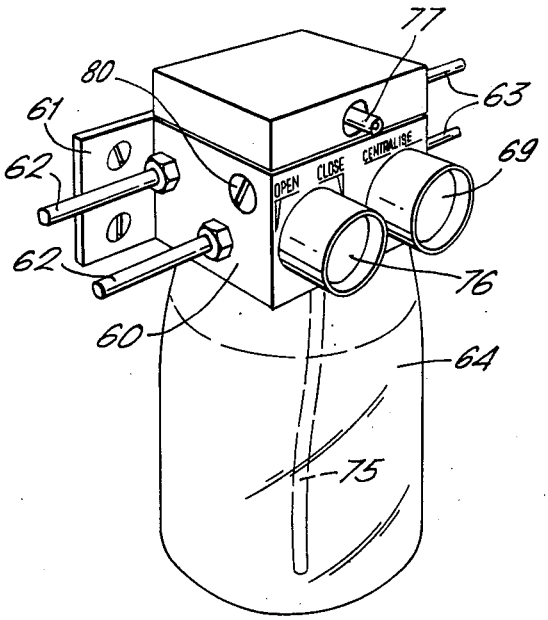
FIG. 4 is a pictorial view of the recuperator unit.
Figure 5:
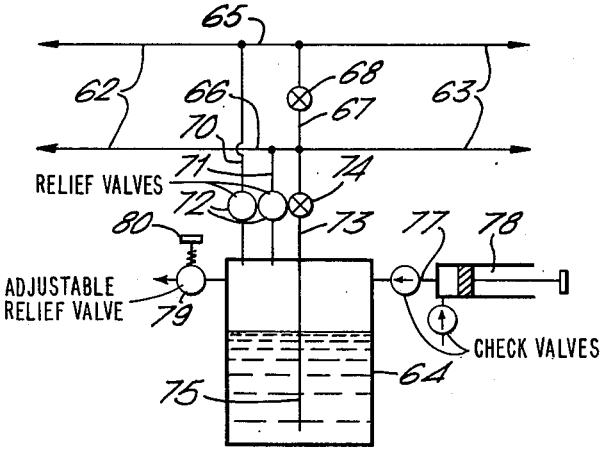
FIG. 5 is a diagram of the internal connections of the recuperator unit to the conduits connecting the transmitter and receiver units.

As previously mentioned, the conduits connecting the respective working chambers of the transmitter unit (FIGS. 1 and 2) and the receiver unit (FIG. 3) communicate with a recuperator unit shown pictorially in FIG. 4 and diagrammatically in FIG. 5. In the present embodiment the recuperator unit is separate from the transmitter and receiver units and is adapted to be mounted in a convenient location on a watercraft without compromising the mounting and location of the other two units. However usually it will be convenient to mount the recuperator unit near to one or other of the transmitter and receiver units and in certain embodiments the recuperator may be associated and structurally integrated with one of the other units.

The recuperator unit comprises a body 60 of generally box like configuration having mounting lugs 61 or equivalent devices by means of which it may be affixed to the structure of a watercraft. At one side the body 60 is formed with connections for conduits 62 that extend to the working chambers 8, 9 of the transmitter unit while at the other side the body 60 has connections for conduits 63 extending to the connections 48 for the working chambers 49, 50 of the receiver unit actuator. The corresponding conduit connections on opposite sides of the body 60 are internally connected by passages within the body in the manner indicated by the diagram of FIG. 5.

The underside of the body is formed with an internally screwthreaded aperture that receives the externally screwthreaded neck of a reservoir container 64 that is conveniently formed of polyethylene or other transparent or translucent plastics material. The reservoir 64 conveniently has a capacity of about 500cc.

The body 60 is formed with internal passages and fitted with valves arranged, functionally, as indicated by the diagram of FIG. 5. Thus in FIG. 5 the internal passages connecting the corresponding conduits 62, 63, are identified as lines 65 and 66 and it will be seen that these passages are interconnected by a cross connection 67 that includes a centralising valve 68 that is conveniently biassed by spring loading to a closed position and openable by pressing on a knob 69 (FIG. 4) on the body 60 but which may be a screwdown needle valve controlled by the knob 69.

The passages 65, 66 are respectively connected by passages 70, 71 and individual relief valves 72 to the housing aperture that receives the reservoir 64 so that excess working fluid in the conduits 62, 63 may discharge into the reservoir 64.

The passage 66 is also connected by a line 73 and a makeup valve 74 to a point near the bottom of the reservoir 64, for which purpose the line 73 includes a pipe 75 that extends through the aperture in the underside of the housing 60 and depends into the reservoir 64. The makeup valve 75 may be a screwdown needle valve controlled by a knob 76 on the housing 60.

Means are provided for pneumatically pressurising the reservoir 64 and in the illustrated embodiment such means comprise a connection 77 on the body 60 to which a hand pump or the like — e.g. a tire inflation pump — may be connected. The connection 77 communicates through a passage including a non-return valve with the aperture in the underside of the housing 60 and thus with the upper part of the reservoir 64. In the diagrammatic representation of FIG. 5 the air pump connection is shown for convenience as communicating directly with the reservoir 64 through one side thereof and the diagram of FIG. 5 showns an air pump 78 connected to the connection 77.

The body 60 further houses a reservoir pressure relief valve 79 having an adjusting element 80 by means of which the relieving pressure may be set.

The illustrated equipment is intended to be constructed mainly of plastics materials (the driving shaft 17 and the piston rod 42 being the only major components made of metal) and to use as working fluid water containing a glycol-type anti-freeze. Upon installation of the equipment components in a small watercraft and establishment of the conduit connections between the transmitter unit, recuperator unit and receiver unit, the working chambers of the transmitter and receiver units are conveniently charged with the working fluid by the use of the recuperator unit.

Thus the reservoir 64 of the recuperator unit is filled substantially full of working fluid and fitted in place on the underside of the housing 60. The makeup valve 74 is opened and the reservoir pneumatically pressurised by operation of a suitable air pump 78 connected to the air pump connection 77. Working fluid is thus expelled from the reservoir 64 through the pipe 75 and line 73 into the passage 66 to flow through corresponding conduits 62 and 63 to working chambers of the transmitter unit and receiver unit actuator respectively. To enable the fluid to flow freely to these connected chambers, the bleed valve of the transmitter unit is fully opened by rotating the valve member 31 to withdraw the valve head 33 wholly into the large bore portion of the valve body 26, as shown in FIG. 2. Similarly, bleed valves 81 fitted to the bosses 47 of the end caps 44, 45 of the receiver unit actuator are opened to permit the escape of air from the respective working chambers.

It will be seen that if during the charging procedure just described the centralising valve 68 is closed, working fluid will flow only in those lines 62, 63 connected to the passage 66 in the recuperator unit and thus only to one pair of connected working chambers of the transmitter and receiver units. However when the transmitter unit working chamber in question becomes full of working fluid, fluid will commence to escape at the nipple 38. At this time the valve member 31 may be partly screwed into the valve body 26 so as to isolate the passage 37 from the bore of the boss 25 and so prevent loss of working fluid through that passage. However, this leaves open communication between the posts 28 and 29 so that working fluid may flow to the other working chamber of the transmitter unit and thence via the associated conduits 62, 63 to the connected working chamber of the receiver unit actuator.

An alternative procedure, if desired, involves opening the centralising valve 68 during the charging operation so that working fluid may flow from the line 73 into both of the passages 65, 66 and thence to both pairs of conduits 62, 63 and their associated working chambers.

Air is preferably purged from the system during the latter part of the charging operation by exercising at least the transmitter unit while the bleed valves 81 are open. However, when the system has been purged of air, the bleed valves 81 are closed. The charging and purging operation may involve refilling of the reservoir 64 one or more times and its final topping up to a suitable level (partly-filled) at the conclusion of the charging and purging operation.

While the makeup valve 74 remains open and with the bypass valve also open, the reservoir 64 is pressurised to the point at which the relief valve 79 commences to relieve: accordingly the working fluid pressure within the system is brought to a value determined by the setting of the relief valve 79. The makeup valve 74 is then closed and the bypass valve adjusted to its fully-closed position (FIG. 1) to isolate the working chambers 8, 9 from each other.

When the system has been charged, purged and pressurised as above described the positions of the transmitter unit and receiver unit are synchronised by opening the centralising valve 68 and manipulating the two units until they are in corresponding synchronised settings. Usually it will be convenient to synchronise the units at a corresponding stroke-end position or at their mid-stroke positions. When the units are sychronised the centralising valve is closed.

As an alternative to charging the system with working fluid by use of the recuperator unit as above described, charging may be effected via the passage 37 of the bypass and bleed valve of the transmitter unit: with this valve fully-open (FIG. 2) and the bleed valves 81 open working fluid from a suitable source (e.g. a pressurised container) may be introduced through a line connected to the nipple 38 for the purpose. The recuperator unit would thereafter be utilised as described to adjust the working fluid pressure in the system to the desired value, to receive excess fluid and to supply makeup fluid as required during operation.

However, charging via the recuperator is the preferred procedure because it facilitates maintenance of clean working fluid in the system by reducing the possibilities of contamination entering the system.

Thus, for instance, the reservoir 64 might be constituted by the body of a container in which working fluid is dispensed or sold to the user, this container being obtained filled and closed with a foil seal and/or screw cap and being intended to be opened and immediately fitted to the recuperator body 60 when the system is to be charged.

The recuperator unit reservoir may typically be pneumatically pressurised to a pressure in the range 0–50 psig, the pressure value chosen being such as to provide a required "stiffness" and response characteristic to suit a particular installation: in general, higher pressures provide greater "stiffness" and quickness response than lower pressures in any particluar installation.

We claim:

1. Position-transmitting apparatus comprising:

A. a transmitter unit including a. a housing having two ends, b. a cylinder and c. means for moving the cylinder axially within the housing in accordance with position information to be transmitted, d. a transverse partition fixedly secured to and dividing said cylinder into two working chambers, e. an individual tubular plunger fixed to each end of said housing and having sealing telescopic relationship to said cylinder so that axial movement of the cylinder with respect to the housing causes relative displacement of said plungers and the cylinder to effect differential adjustment of the volumes of said working chambers; and B. a receiver unit including a double-acting hydraulic actuator having working chambers adapted for connection via said plungers to the working chambers of the cylinder of said transmission unit, thereby to respond to adjustment of said cylinder within said housing.

2. The apparatus of claim 1, in which said housing is tubular and substantially coaxially disposed with respect to said cylinder and said plungers, and said means for moving the cylinder within the said housing comprise a pinion on a shaft carried by said housing and meshing with rack teeth formed on the exterior of said cylinder.

3. The apparatus of claim 2, in which said partition extends across-the bore of said cylinder midway between its ends, and said transmitter unit includes a valve assembly in the region of said partition, said valve assembly controlling passages by means of which the working chambers of said cylinder may be put into communication with one another.

4. The apparatus of claim 3, in which said valve assembly provides for connection of the working chambers of said cylinder selectively with one another and with an external fluid connection.

5. The apparatus of claim 4, in which said valve assembly comprises an internally screwthreaded sleeve extending from a tubular boss on the external wall of the cylinder in the region of the said partition therein, an aperture on the axis of the boss communicating with a passage leading to the working chamber on one side of said partition, while an offset aperture within the boss communicates with a passage extending to the other working chamber.

6. The apparatus of claim 5, in which the bore of said boss is finished to mate with a peripheral seal on a valve head having a central protuberance for closing said axial aperture, a stem carrying said valve head having an external screwthread co-operating with the screwthread in the sleeve so that rotation of the stem serves to move the valve head towards and away from the said apertures.

7. The apparatus of claim 6, in which said sleeve is of larger bore than said boss and joins the latter in a tapering bore section, so that the valve head can be partly withdrawn to provide communication between the two working chambers via the bore of the boss, and fully withdrawn into the sleeve to provide access between the bore of the boss and the bore of the sleeve behind said seal on the valve head, thereby to provide communication between the working chambers and bleed passage in the valve head behind its seal, the bleed passage extending to the external end of the valve stem.

8. The apparatus of claim 1, in which said receiver unit comprises a cylinder having a piston reciprocable therein, a piston rod carrying said piston extending through a gland at one end of the cylinder, each end of the cylinder having a connection for a conduit leading to the associated working chamber of the transmitter unit.

9. The apparatus of claim 1, including a recuperator unit in circuit with the working chambers of the transmitting unit and of the receiver unit.

10. The apparatus of claim 9, in which each working chamber of the transmitter unit is connected to the corresponding working chamber of the receiver unit via an individual passage in said recuperator unit, the respective passages in the latter being connected via individual pressure relief valves to a reservoir for pressurised working fluid.

11. The apparatus of claim 10, in which said reservoir comprises a vessel adapted to be pneumatically pressurized to maintain working fluid therein under a required pressure and means for pneumatically pressurizing said vessel.

* * * * *